United States Patent [19]

Matsuda et al.

[11] 4,304,831

[45] Dec. 8, 1981

[54] BLACK-COLOR FORMING TWO-COMPONENT TYPE DIAZO COPYING MATERIAL

[75] Inventors: Tsutomu Matsuda; Masanori Rimoto, both of Numazu, Japan

[73] Assignee: Ricoh Co., Ltd., Tokyo, Japan

[21] Appl. No.: 63,308

[22] Filed: Aug. 2, 1979

[30] Foreign Application Priority Data

Aug. 8, 1978 [JP] Japan ..... 53-96351

[51] Int. Cl.[3] ..... G03C 1/58; G03C 1/54

[52] U.S. Cl. ..... 430/173; 430/148; 430/149; 430/180; 430/181; 430/182; 430/170

[58] Field of Search ..... 430/173, 148, 181, 182, 430/180, 170

[56] References Cited

U.S. PATENT DOCUMENTS

| | | | |
|---|---|---|---|
| 2,537,001 | 1/1951 | Von Glahn et al. | 430/173 |
| 2,542,566 | 2/1951 | Pedlow et al. | 430/148 |
| 2,542,715 | 2/1951 | Slifkin | 430/148 |
| 2,717,832 | 9/1955 | Sulich | 430/173 |
| 3,473,930 | 10/1969 | Werner et al. | 430/173 |
| 3,615,575 | 10/1971 | Rauhut | 430/173 |
| 3,708,301 | 1/1973 | Muller | 430/173 |
| 3,836,369 | 9/1974 | Looney et al. | 430/173 |
| 3,881,931 | 5/1975 | Tsubota et al. | 430/173 |

FOREIGN PATENT DOCUMENTS

| | | | |
|---|---|---|---|
| 51-126128 | 11/1976 | Japan | 430/182 |

OTHER PUBLICATIONS

Kosar, J., "Light-Sensitive Systems", J. Wiley & Sons, pp. 210, 211, 220, 231, 233, 237, 241, 242, 302-303; 1965.

Dinaburg, M. S., "Photosensitive Diazo Compounds", Focal Press, 1964, pp. 103-104.

*Primary Examiner*—Charles L. Bowers, Jr.

*Attorney, Agent, or Firm*—Blanchard, Flynn, Thiel, Boutell & Tanis

[57] ABSTRACT

A two-component type diazo copying material according to this invention, which comprises a support and a photosensitive layer formed thereon, said layer consisting essentially of a diazo compound expressed by the following general formula I and a coupler mixture consisting of a compound expressed by the following formula II, a compound expressed by the following general formula III and a compound expressed by the following general formula IV, can form a genuine black-color image and is especially optimum for preparing a secondary original used in electrophotographic copying machines. General formula I (wherein R represents alkyl radical having 1 to 5 carbon atoms; $R_1$ and $R_2$ represent substituted or non-substituted alkyl radical, aralkyl radical or cycloalkyl radical, or $R_1$ and $R_2$ may form a heterocyclic ring together with the nitrogen atom to which they bond; and X represents anion.)

Formula II

General formula III (wherein X is of no account or represents O, S, SO or $SO_2$.)

General formula IV

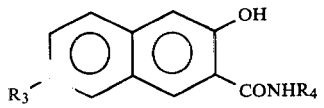

[wherein $R_3$ represents hydrogen, alkyl radical having 1 to 4 carbon atoms or halogen; $R_4$ represents hydrogen, $-(CH_2)_nOH$ (wherein n is an integer ranging from 2 to 4) or

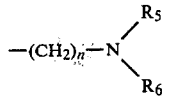

(wherein n is an integer ranging from 2 or 4; $R_5$ and $R_6$ represent alkyl radical having 1 to 4 carbon atoms, or $R_5$ and $R_6$ may form heterocyclic ring together with nitrogen atoms to which they bond.)]

3 Claims, 1 Drawing Figure

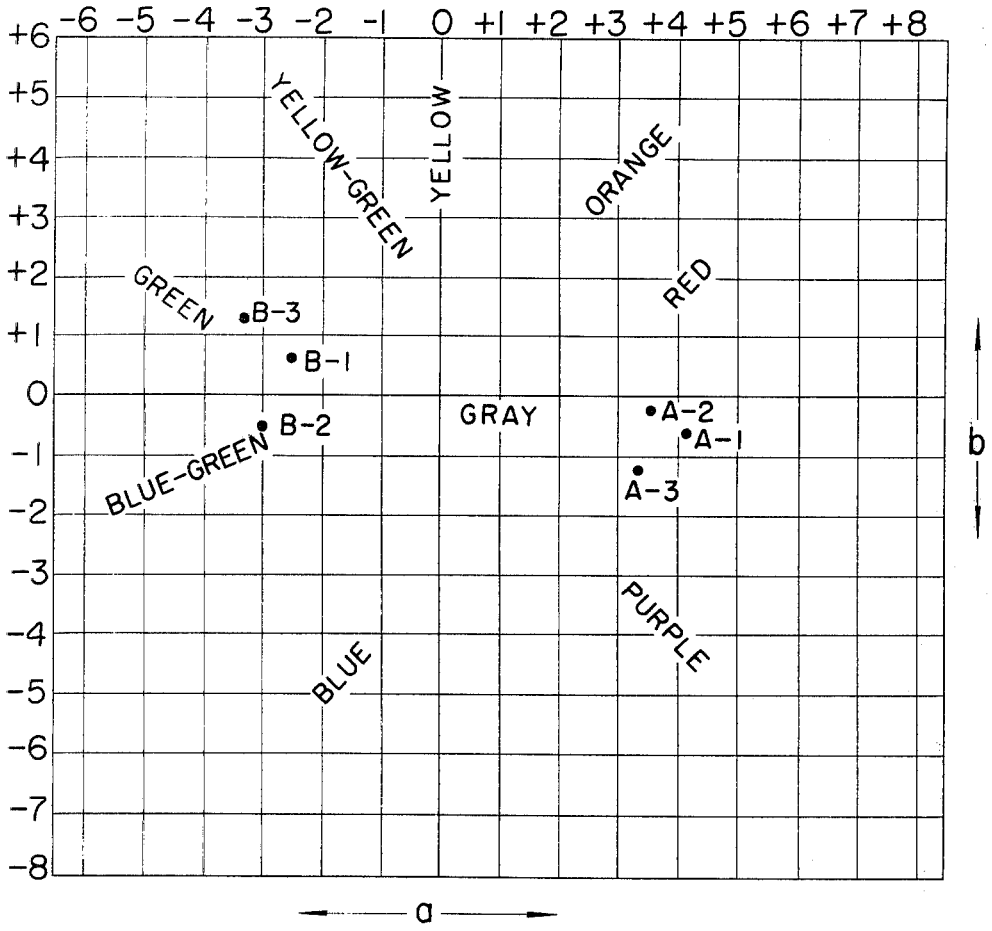
-6 -5 -4 -3 -2 -1 0 +1 +2 +3 +4 +5 +6 +7 +8
+6 +5 +4 +3 +2 +1 0 -1 -2 -3 -4 -5 -6 -7 -8
YELLOW-GREEN
YELLOW
ORANGE
GREEN
RED
B-3
B-1
B-2
GRAY
A-2
A-1
A-3
BLUE-GREEN
PURPLE
BLUE
a
b

BLACK-COLOR FORMING TWO-COMPONENT TYPE DIAZO COPYING MATERIAL

BACKGROUND OF THE INVENTION (a) Field of the Invention

This invention relates to a genuine black-color forming two-component type (or binary) diazo copying material suitable especially for preparing a secondary original used in electrophotographic copying machines.

(b) Description of the Prior Art

As conventional binary diazo copying materials capable of black-color forming, there are known those employing a blue-color forming coupler, such as β-naphthol derivative, in combination with a yellow-color forming coupler, such as acetoamide derivative and phenol derivative. However, said acetoamide derivative useful as the yellow-color forming coupler is defective because it is higher in coupling speed than general couplers so that a copying material comprising these compounds is apt to cause precoupling with the diazo compound during prolonged storage, and when it is employed jointly with a β-naphthol derivative, due to the difference of coupling speed between these two compounds, just a slight change of the developing conditions, that is, the developing temperature, the pH value of the developer solution, the amount of the developer solution attached, etc. would cause a change of the color tone of dye image, resulting in a failure to form a genuine black-color image. As to said phenol derivative for use as a yellow-color forming coupler, although it does not cause precoupling because it is lower in coupling speed than general couplers, when it is employed jointly with a β-naphthol derivative, due to difference of the coupling speeds of the two compounds, the foregoing phenomenon would occur.

With a view to eliminating these defects, the present inventors have previously proposed the use of cyanoacetoamide derivatives as yellow-color forming couplers in Japanese Laid-open Application No. 126128/1976. However, a copying material comprising these compounds cannot produce a genuine black-color image, and the color tone of the resulting image is close to a green color. Therefore, especially the visual density of the half-tone area of the image is low, thereby making the copy indistinct. Further, in the case of preparing recopies from this copy by means of a commercial reflex-printing copying machine, such as an electrophotographic copying machine, there would occur the trouble that clear-cut recopies cannot be obtained.

SUMMARY OF THE INVENTION

The object of this invention is to provide a binary diazo copying material which can form a genuine black-color image and is especially optimum for preparing a secondary original useful in electrophotographic copying by combining a yellow-color forming coupler consisting of a cyanoacetoanilide derivative and a blue-color forming coupler, as above, with a red-color forming coupler, and further adding thereto a specific diazo compound.

In other words, a black-color forming binary diazo copying material according to this invention comprises a support and a photosensitive layer consisting essentially of a diazo compound and coupler component formed on said support, in which said diazo compound is a compound expressed by the general formula I

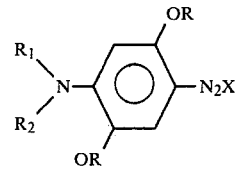

wherein R represents an alkyl radical having 1 to 5 carbon atoms; $R_1$ and $R_2$ represent substituted or non-substituted alkyl radical, aralkyl radical or cycloalkyl radical, or $R_1$ and $R_2$ may form a heterocyclic ring, together with the nitrogen atom to which they bond; and X represents an anion, and said coupler consists of a compound expressed by the formula II

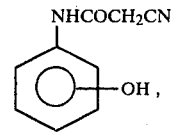

a compound expressed by the general formula III

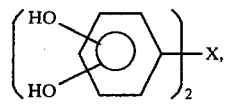

wherein X is a valence bond or represents O, S, SO or $SO_2$, and a compound expressed by the general formula IV

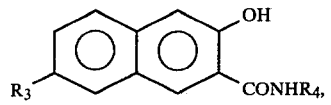

wherein $R_3$ represents hydrogen, alkoxy radical having 1 to 4 carbon atoms or halogen; $R_4$ represents hydrogen, $-(CH_2)_nOH$ wherein n is an integer ranging from 2 to 4, or

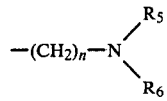

wherein n is an integer ranging from 2 to 4, $R_5$ and $R_6$ represent alkyl radical having 1 to 4 carbon atoms, or $R_5$ and $R_6$ may form heterocyclic ring together with the nitrogen atom to which they bond.

In this connection, the compound expressed by the formula II is employed as a coupler yielding a yellow-dye when coupled with said diazo compound, the compound expressed by the general formula III is employed as a coupler yielding a red dye when coupled with said diazo compound, and the compound expressed by the general formula IV is employed as a coupler yielding a blue dye when coupled with said diazo compound. The appropriate mixing ratio of the respective couplers in terms of mole ratio is in the following range:

compound of formula II: compound of general formula III:

compound of general formula IV = 1:0.1–1.0:0.5–2.0 In this context, the appropriate ratio of the amount of said diazo compound to the total amount of said couplers in terms of mole ratio is in the range of 1–0.2:1–2.0 or thereabout.

As concrete examples of the diazo compound expressed by the general formula I, there are 4-diazo-2,5-dimethoxyphenyl morpholine, 4-diazo-2,5-diethoxyphenyl morpholine, 4-diazo-2,5-dipropoxyphenyl morpholine, 4-diazo-2,5-dibutoxyphenyl morpholine, 4-diazo-2,5-dibutoxy-N-benzyl-N-ethyl aniline, 4-diazo-2,5-dibutoxy-N,N-dibutyl aniline, 4-diazo-2,5-dibutoxy-N-benzyl-N-oxyethyl aniline, etc.

To cite applicable yellow-color forming couplers expressed by the formula II, there are 2-hydroxycyanoacetoanilide, 3-hydroxycyanoacetoanilide and 4-hydroxycyanoacetoanilide.

To cite applicable red-color forming couplers expressed by the general formula III, there are 2,2',4,4'-tetrahydroxydiphenyl sulfide, 2,2',4,4'-tetrahydroxydiphenyl sulfoxide, 2,2',4,4'-tetrahydroxydiphenyl sulfodioxide, 2,2',4,4'-tetrahydroxydiphenyl oxide, etc.

Applicable blue-color forming coupler expressed by the general formula IV are 2-hydroxy-3-naphthoic acid dimethylaminoethyl amide, 2-hydroxy-3-naphthoic acid diethylaminoethyl amide, 6-bromo-2-hydroxy-3-naphthoic acid diethylaminoethyl amide, 2-hydroxy-3-naphthoic acid dipropylaminopropyl amide, 6-methoxy-2-hydroxy-3-naphthoic acid dipropylaminopropyl amide, 2-hydroxy-3-naphthoic acid diethylaminopropyl amide, 6-bromo-2-hydroxy-3-naphthoic acid diethylaminopropyl amide, 2-hydroxy-3-naphthoic acid dimethylaminopropyl amide, 6-methoxy-2-hydroxy-3-naphthoic acid dimethylaminopropyl amide, 2-hydroxy-3-naphthoic acid morpholinoethyl amide, 6-bromo-2-hydroxy-3-naphthoic acid morpholinoethyl amide, 6-chloro-2-hydroxy-3-naphthoic acid morpholinoethyl amide, 2-hydroxy-3-naphthoic acid piperidinopropyl amide, 6-ethoxy-2-hydroxy-3-naphthoic acid piperidinopropyl amide, 2-hydroxy-3-naphthoic acid morpholinopropyl amide, 6-butoxy-2-hydroxy-3-naphthoic acid morpholinopropyl amide, 6-bromo-2-hydroxy-3-naphthoic acid morpholinopropyl amide, 2-hydroxy-3-naphthoic acid amide, 2-hydroxy-3-naphthoic acid ethanol amide, 2-hydroxy-3-naphthoic acid ethanol amide-5-sodium sulfonate, 2-hydroxy-3-naphthoic acid propanol amide, etc.

Further, the foregoing compounds expressed by the respective general formulas can be used either individually or in the form of a mixture.

A diazo copying material of this invention can be prepared by the same procedure as that for preparing general binary diazo copying materials. That is, it will do to coat a photosensitive aqueous solution obtained by mixing the aforedescribed ingredients on a paper support and dry it thereafter. If necessary, a precoating layer consisting essentially of silica and a binder may be provided on said support in order to control the permeation of the photosensitive solution to a paper support and/or to improve the resulting image density. The appropriate amount of the photosensitive aqueous solution adhered to the support is from 0.2 to 2 g per square meter, after drying. Moreover, for the photosensitive liquid, the same additives as applicable to general binary diazo copying materials can also be employed jointly. That is, naphthalene-mono, di- or tri-sodium sulfonate, sulfosalicylic acid, cadmium sulfate, aluminum sulfate, magnesium sulfate, cadmium chloride, zinc chloride, etc. as storage stabilizer, thiourea, urea, etc. as antioxidant, caffeine, theophylline, etc. as solubilizing agent, and citric acid, tartaric acid, sulfuric acid, oxalic acid, boric acid, phosphoric acid, pyrophosphoric acid, etc. as acid stabilizer are applicable. Further, a modicum of saponin can be added.

As regards the developing method applicable to the diazo copying materials of this invention, any of the conventional methods, namely, the dry developing process employing ammonia or organic amine, the wet developing process employing alkaline aqueous solution and the semi-dry developing process employing alkaline organic solution, is applicable. In this context, said alkaline aqueous solution means an aqueous solution (having a pH value ranging from 9 to 13) of either individual substance selected from potassium carbonate, potassium hydroxide, tetraborate, potassium metaborate, sodium carbonate, etc. or a mixture of such substances, and said alkaline organic solution means a solution obtained by dissolving an organic amine or an inorganic alkaline substance in a solvent consisting of glycol or glycol ether alone or a mixture of the two. This alkaline organic solution is applied by coating a modicum thereof (viz. about 5 g/m$^2$ or less) on the copying material.

BRIEF DESCRIPTION OF THE FIGURE

The drawing is a diagram illustrating the color tones of the copied images obtained from the copying materials of this invention as prepared in Example 1 and the comparative examples.

In the diagram, the data points are as follows:

A-1: A copy according to this invention obtained by a dry developing process.

A-2: A copy according to this invention obtained by a wet developing process.

A-3: A copy according to this invention obtained by a semi-dry developing process.

B-1: A copy for comparison obtained by a dry developing process.

B-2: A copy for comparison obtained by a wet developing process.

B-3: A copy for comparison obtained by a semi-dry developing process.

In the following will be shown examples embodying this invention.

DESCRIPTION OF THE PREFERRED EMBODIMENTS

EXAMPLE 1

A photosensitive layer forming liquid was prepared by mixing the following ingredients:

| | |
|---|---|
| water | 100 ml |
| phosphoric acid | 2 g |
| sodium naphthalene-1,3,6-trisulfonate | 1 g |
| 2-hydroxy-3-naphthoic acid morpholinopropyl amide | 0.6 g |
| 2-hydroxycyanoacetoanilide | 0.4 g |
| 2,2',4,4'-tetrahydroxydiphenyl sulfoxide | 0.2 g |
| 4-diazo-2,5-dibutoxyphenyl morpholine chloride . ½ $ZnCl_2$ | 2 g |
| saponin | 0.1 g |

Subsequently, by coating this photosensitive layer forming liquid on a white stencil paper for diazo copying material and drying thereafter, there was obtained a binary diazo copying material A. When this copying material was superposed on an original having an appropriate image, exposed to a fluorescent light of 160 W for about 4 seconds by the use of a commercial wet-process diazo copying machine and thereafter developed with a liquid developer 1 having the following composition, there was obtained a copy having a genuine black-color dye image of high density. This copy is hereinafter referred to as Copy A-1.

| | |
|---|---|
| water | 100 ml |
| potassium carbonate | 2 g |
| potassium metaborate | 8 g |

When the same copying material was exposed to light in the same way as above and thereafter developed with ammonia gas by the use of a commercial dry process diazo copying machine, there was obtained a genuine black-color dye image of high density like in the case of the wet developing. This copy is hereinafter referred to as Copy A-2.

Further, when the same copying material was exposed to light in the same way as above and thereafter developed with a liquid developer 2 having the following composition, such that the adhered amount of the developer to the photosensitive layer was about 2.5 g/m$^2$, using a semi-dry process diazo copying machine, there was obtained a genuine black-color dye image of high density like in the foregoing case. This copy is hereinafter referred to as Copy A-3.

| liquid developer 2: | |
|---|---|
| monoethanolamine | 15 g |
| diethylene glycol monomethyl ether | 50 g |
| ethylene glycol | 85 g |

On the other hand, in order to examine the effect of mixing the red-color forming coupler expressed by the general formula III in this example, another diazo copying material B for the purpose of comparison was prepared in the same way as above except for omission of 0.2 g of 2,2',4,4'-tetrahydroxydiphenyl sulfide, and subsequently by subjecting this copying material B to the aforesaid 3 kinds of developing processes, there were obtained Copy B-1, Copy B-2 and Copy B-3, respectively.

Further, for the purpose of comparing the color tone as well as the image density of the thus obtained copies, the respective value of L, a and b was measured by the use of a commercial color difference meter. The result of this measurement was as shown in the following table. In this context, L represents brightness, and the larger is the value thereof, the brighter is the color tone, that is, the density is lower, while the smaller is the value thereof, the darker is the color tone, to wit, the density is higher.

Both a and b represent color appearance: when the value of a is of a negative number, the color appearance shows a tendency to green color, and when it is of a positive number, the color appearance shows a tendency to red color; when the value of b is of a negative number, the color appearance shows a tendency to blue color, and when it is of a positive number, the color appearance shows a tendency to yellow color.

| | Copy | L | | a | b |
|---|---|---|---|---|---|
| | | image area | half-tone area | | |
| Example | A-1 | 28.0 | 39.2 | 4.2 | −0.6 |
| | A-2 | 27.6 | 37.8 | 3.6 | 0.2 |
| | A-3 | 30.1 | 41.5 | 3.4 | −1.2 |
| Comparative Example | B-1 | 26.1 | 32.4 | −2.5 | −0.6 |
| | B-2 | 25.4 | 31.3 | −3.0 | −0.5 |
| | B-3 | 28.3 | 34.7 | −3.3 | 1.3 |

The results are further illustrated in the drawing.

As is evident from the results of this comparative test, while all copies of the comparative copying material B were of color tone strongly tinged with green, all copies of the copying material A according to this invention were of genuine black color. Besides, the copies according to this invention were high in density of the half-tone area as well and the image lines thereof were easy to see.

Next, the copies according to this invention were recopied by the use of an electrophotographic copying machine. There were always obtained clear-cut recopies.

EXAMPLE 2

A precoating layer forming liquid was prepared by mixing the following ingredients:

| | |
|---|---|
| water | 100 ml |
| fine-particle corn starch (grain size: 1 to 5 μ) | 3 g |
| colloidal silica (grain size: 1 to 5 μ) | 5 g |
| polyvinyl acetate emulsion (solid content: 50%) | 9 g |
| sodium naphthalene-2,5-disulfonate | 1 g |
| Methylene Blue | 0.003 g |

On the other hand, a photosensitive layer forming liquid was prepared by mixing the following ingredients:

| | |
|---|---|
| water | 100 ml |
| citric acid | 5 g |
| caffeine | 1 g |
| aluminum sulfate | 1 g |
| 3-hydroxycyanoacetoanilide | 0.5 g |
| 2,2',4,4'-tetrahydroxydiphenyl sulfide | 0.3 g |
| 2-hydroxy-3-naphthoic acid diethylaminopropyl amide | 1 g |
| 4-diazo-2,5-dibutoxyphenyl morpholine chloride . ½ $ZnCl_2$ | 2.4 g |
| saponin | 0.1 g |

Subsequently, after coating the foregoing precoating layer forming liquid on the same white stencil paper as used in Example 1 and drying, by coating thereon said photosensitive layer forming liquid and drying thereafter, there was obtained a binary diazo copying material. When the thus prepared copying material was subjected to the same dry developing as that in Example 1, there was obtained a copy having a genuine black-color dye image of high density like in the case of Example 1. The respective value of L, a and b of this copy was as follows:

$$L=22.4,\ a=4.3,\ b=-1.6$$

Further, when the same copying material was subjected to wet developing and semi-dry developing in the same way as in Example 1 except for the employment of the following liquid developer 3 and 4, respectively, there was obtained a genuine black-color dye image of high density like in the case of Example 1.

| | |
|---|---|
| liquid developer 3: | |
| water | 100 ml |
| potassium hydroxide | 1 g |
| potassium metaborate | 3 g |
| liquid developer 4: | |
| water | 35% by weight |
| monoethanol amine | 5% by weight |
| ethylene glycol | 40% by weight |
| potassium metaborate | 20% by weight |

EXAMPLE 3

A precoating layer forming liquid was prepared by mixing the following ingredients:

| | |
|---|---|
| water | 100 ml |
| colloidal silica (grain size: 1 to 5 μ) | 4 g |
| polyvinyl acetate emulsion (solid content: 50%) | 7 g |
| Methylene Blue | 0.002 g |

On the other hand, a photosensitive layer forming liquid was prepared by mixing the following ingredients:

| | |
|---|---|
| water | 90 ml |
| ethylene glycol | 10 ml |
| zinc chloride | 2 g |
| tartaric acid | 3 g |
| 2-hydroxy-3-naphthoic acid ethanol amide | 1 g |
| 4-hydroxycyanoacetoanilide | 0.4 g |
| 2,2',4,4'-tetrahydroxydiphenyl sulfodioxide | 0.2 g |
| 4-diazo-2,5-diethoxyphenyl morpholin chloride . ½ $ZnCl_2$ | 1.6 g |
| saponin | 0.1 g |

Then, in the same way as in Example 2 except for the employment of the foregoing precoating layer forming liquid and photosensitive layer forming liquid, a binary diazo copying material was prepared. This copying material could form a genuine black-color image of high density like in the case of Example 1 through dry developing. The respective values of L, a and b of this image were as follows:

L=21.4, a=3.1, b=0.3

EXAMPLE 4

In the same way as in Example 2 except for the employment of a photosensitive layer forming liquid consisting of the following ingredients, a binary diazo copying material was prepared.

| | |
|---|---|
| water | 90 ml |
| ethylene glycol | 10 ml |
| tartaric acid | 3 g |
| zinc chloride | 2 g |
| urea | 2 g |
| 2-hydroxy-3-naphthoic acid dimethylaminoethyl amide | 1 g |
| 2-hydroxycyanoacetoanilide | 0.6 g |
| 2,2',4,4'-tetrahydroxydiphenyl sulfide | 0.4 g |
| 4-diazo-2,5-dipropoxyphenyl morpholine chloride . ½ $ZnCl_2$ | 2 g |

-continued

| | |
|---|---|
| saponin | 0.1 g |

When the thus obtained diazo copying material was then subjected to dry developing, wet developing and semi-dry developing in the same way as in Example 2, there was formed a genuine black-color dye image of high density, respectively. The respective value of L, a and b on this occasion were as follows:

| | dry developing | wet developing | semi-dry developing |
|---|---|---|---|
| L | 21.2 | 22.7 | 22.4 |
| a | 2.9 | 3.3 | 3.1 |
| b | −1.3 | 0.2 | −1.5 |

As is evident from the values of L, a and b shown in the foregoing examples, by virtue of appropriate combinations of diazo compound and coupler, there can be obtained genuine black-color dye images of high density.

What is claimed is:

1. A black-color forming binary diazo copying material comprising a support and an acid-stabilized photosensitive layer consisting of diazo compound and a coupler component formed on said support, in which said diazo compound is a compound having the formula I

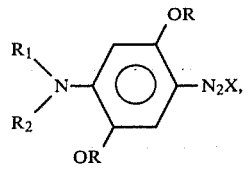

wherein R is alkyl having 1 to 5 carbon atoms; $R_1$ and $R_2$ are substituted or non-substituted alkyl, aralkyl or cycloalkyl, or

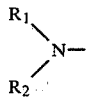

forms a heterocyclic ring and X represents an anion, and said coupler component consists essentially of a mixture of a compound having the formula II

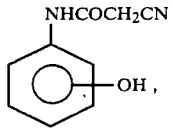

a compound having the formula III

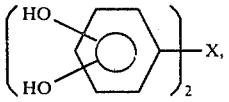

wherein X is a valence bond or is O, S, SO or $SO_2$, and a compound having the formula IV

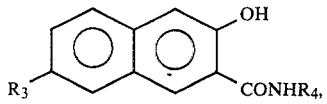

wherein $R_3$ is hydrogen, alkoxy having 1 to 4 carbon atoms or halogen; $R_4$ is hydrogen, $-(CH_2)_n$ OH, wherein n is an integer ranging from 2 to 4, or

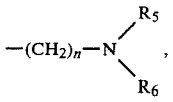

wherein n is an integer ranging from 2 to 4, $R_5$ and $R_6$ are alkyl having 1 to 4 carbon atoms, or

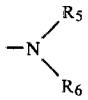

forms a heterocyclic ring and in which the mole ratio of said diazo compound to the total amount of said coupler component is in the range of 1–0.2:1–2 and in which the mole ratio of said formula II compound, said formula III compound and said formula IV compound is in the range of 1:0.1–1.0:0.5–2.0.

2. A copying material according to claim 1 in which said formula I compound is selected from the group consisting of 4-diazo-2,5-dimethoxyphenyl morpholine, 4-diazo-2,5-diethoxyphenyl morpholine, 4-diazo-2,5-dipropoxyphenyl morpholine, 4-diazo-2,5-dibutoxyphenyl morpholine, 4-diazo-2,5-dibutoxy-N-benzyl-N-ethyl aniline, 4-diazo-2,5-dibutoxy-N,N-dibutyl aniline and 4-diazo-2,5-dibutoxy-N-benzyl-N-oxyethyl aniline; said formula II compound is selected from the group consisting of 2-hydroxycyanoacetoanilide, 3-hydroxycyanoacetoanilide and 4-hydroxycyanoacetoanilide; said formula III compound is selected from the group consisting of 2,2',4,4'-tetrahydroxydiphenyl sulfide, 2,2',4,4'-tetrahydroxydiphenyl sulfoxide, 2,2',4,4'-tetrahydroxydiphenyl sulfodioxide and 2,2',4,4'-tetrahydroxydiphenyl oxide; and said formula IV compound is selected from the group consisting of 2-hydroxy-3-naphthoic acid dimethylaminoethyl amide, 2-hydroxy-3-naphthoic acid diethylaminoethyl amide, 6-bromo-2-hydroxy-3-naphthoic acid diethylaminoethyl amide, 2-hydroxy-3-naphthoic acid dipropylaminopropyl amide, 6-methoxy-2-hydroxy-3-naphthoic acid dipropylaminopropyl amide, 2-hydroxy-3-naphthoic acid diethylaminopropyl amide, 6-bromo-2-hydroxy-3-naphthoic acid diethylaminopropyl amide, 2-hydroxy-3-naphthoic acid dimethylaminopropyl amide, 6-methoxy-2-hydroxy-3-naphthoic acid dimethylaminopropyl amide, 2-hydroxy-3-naphthoic acid morpholinoethyl amide, 6-bromo-2-hydroxy-3-naphthoic acid morpholinoethyl amide, 6-chloro-2-hydroxy-3-naphthoic acid morpholinoethyl amide, 2-hydroxy-3-naphthoic acid piperidinopropyl amide, 6-ethoxy-2-hydroxy-3-naphthoic acid piperidinopropyl amide, 2-hydroxy-3-naphthoic acid morpholinopropyl amide, 6-butoxy-2-hydroxy-3-naphthoic acid morpholinopropyl amide, 6-bromo-2-hydroxy-3-naphthoic acid morpholinopropyl amide, 2-hydroxy-3-naphthoic acid amide, 2-hydroxy-3-naphthoic acid ethanol amide, 2-hydroxy-3-naphthoic acid ethanol amide-5-sodium sulfonate and 2-hydroxy-3-naphthoic acid propanol amide.

3. A copying material according to claim 1 in which said diazo compound is 4-diazo-2,5-diethoxyphenyl morpholine chloride.$\frac{1}{2}$ $ZnCl_2$, said compound having the formula II is selected from the group consisting of 2-hydroxycyanoacetoanilide, 3-hydroxycyanoacetoanilide and 4-hydroxycyanoacetoanilide, said compound having the formula III is selected from the group consisting of 2,2',4,4'-tetrahydroxydiphenyl sulfoxide, 2,2',4,4'-tetrahydroxydiphenyl sulfide and 2,2',4,4'-tetrahydroxydiphenyl sulfodioxide, and said compound having the formula IV is selected from the group consisting of 2-hydroxy-3-naphthoic acid morpholinopropyl amide, 2-hydroxy-3-naphthoic acid diethylaminopropyl amide, 2-hydroxy-3-naphthoic acid ethanol amide and 2-hydroxy-3-naphthoic acid dimethylaminoethyl amide.

* * * * *